US005570726A

United States Patent [19]

Wahhoud et al.

[11] Patent Number: 5,570,726

[45] Date of Patent: Nov. 5, 1996

[54] AIR WEAVING LOOM WITH WEFT HOLD-DOWN MEMBERS AND ENLARGED INLET AND OUTLET WEFT INSERTION CHANNEL

[75] Inventors: Adnan Wahhoud, Lindau; Peter Czura, Wangen, both of Germany

[73] Assignee: Lindauer Dornier Gesellschaft mbH, Lindau/B, Germany

[21] Appl. No.: 499,729

[22] Filed: Jul. 7, 1995

[30] Foreign Application Priority Data

Jul. 9, 1994 [DE] Germany ..... 44 24 271.9

[51] Int. Cl.[6] ..... D03D 47/48; D03D 47/30; D03D 49/62

[52] U.S. Cl. ..... 139/434; 139/192; 139/435.6

[58] Field of Search ..... 139/434, 192, 139/435.6, 435.5

[56] References Cited

U.S. PATENT DOCUMENTS 4,125,133 11/1978 Kobayashi et al. ..... 139/435.6
4,538,649 9/1985 Kobayashi et al. ..... 139/435.5
4,905,741 3/1990 Wahhoud et al. ..... 139/435.6

FOREIGN PATENT DOCUMENTS 0291744 11/1988 European Pat. Off. .
0431484 6/1991 European Pat. Off. .
0534429 3/1993 European Pat. Off. .

*Primary Examiner*—Andy Falik
*Attorney, Agent, or Firm*—W. G. Fasse; W. F. Fasse

[57] ABSTRACT

An air weaving loom is equipped with a reed in which the weft thread insertion channel has an inlet channel section and an outlet channel section. Both the inlet and outlet sections have enlarged cross-sectional areas to provide space for the operation of a respective hold-down member that keeps the weft thread in position when the ends (8A) of the weft thread (8), after cutting at the inlet end, are blown back into the selvage formation by respective nozzles (20) that cooperate with the respective hold-down member (2).

11 Claims, 5 Drawing Sheets

AIR WEAVING LOOM WITH WEFT HOLD-DOWN MEMBERS AND ENLARGED INLET AND OUTLET WEFT INSERTION CHANNEL

FIELD OF THE INVENTION

The invention relates to air weaving looms and more specifically to an air weaving loom equipped with features for the binding of the leading end of the weft thread and of the trailing end of the weft thread into the respective selvage.

BACKGROUND INFORMATION

It is known to bind the free leading and trailing ends of a weft thread into the respective selvage. Reference is made in this connection to European Patent Publications EP 0,291, 744 A2 (Henzl et al.) published on Nov. 23, 1988; EP 0,534 429 A1, (Viscardi) published on Mar. 31, 1993; and EP 0 431 484 A1 (Schwemmlein et al.) published on Jun. 12, 1991. Conventionally the cut ends of the weft thread are blown back by respective auxiliary air nozzles into the fabric selvage as it is being formed.

It is a disadvantage in conventional selvage forming devices of this type that the end of the weft thread is merely inserted into the next following loom shed, but it is not fixed during the time of insertion whereby an uneven selvage is formed. This feature of conventional selvage formation techniques is especially undesirable where the fabric has low weft thread densities in the range of, for example 0.5 to 1.5 weft threads per centimeter length of warp yarns. In such situations the weft thread ends have a tendency to unravel again after the insertion as the next shed is being formed. The weft thread ends form undesirable loops if they partially escape from being bound into the selvage.

As a result, the weft thread ends are not reliably held in the selvage and when the fabric is subjected to its normal use the loops of the weft ends tend to let the weft ends be pulled out again of the fabric selvage. As a result, there is room for improvement in forming smooth tightly bound selvages along both fabric edges.

It has been further noted that the repeated shed formations of the warp threads actually help the unravelling or loop formations of the weft thread ends if the latter are not properly bound into the selvage. Thus, there is further room for improvement in avoiding an adverse effect of the shed formation on the binding of the weft thread ends in the selvage.

OBJECTS OF THE INVENTION

In view of the above it is the aim of the invention to achieve the following objects singly or in combination:

- to assure in an air weaving loom that the looped back weft thread ends are positively and reliably maintained in the looped back position during the shed formation that binds these weft thread ends into the selvage;
- to form along each fabric edge a selvage into which weft thread ends are positively looped back without protruding weft ends, without unravelling, and without wave formations to assure a smooth selvage; and
- to provide sufficient space at the inlet and at the outlet of the weft insertion channel for the proper operation of respective inlet and outlet hold-down members for a proper selvage formation.

SUMMARY OF THE INVENTION

The above objects have been achieved by widening the weft insertion channel at both of its ends and by providing at each widened channel end at least one weft end hold-down member which cooperates with a respective nozzle or nozzles for positively inserting the weft thread ends into the respective selvage. More specifically, a reed in an air weaving loom according to the invention has a weft thread insertion channel with a uniform or constant channel cross-sectional area along an intermediate channel section between a widened weft inlet and the widened weft outlet of the weft insertion channel. A widened cross-sectional area of the inlet diminishes from the channel entrance toward the intermediate channel section while a widened cross-sectional area of the outlet widens away from the intermediate channel section toward the exit of the weft insertion channel. At least one first weft end hold-down member is mounted in the loom frame for operating in the widened weft inlet and a second weft end hold-down member is mounted in the loom frame for operating in the widened weft outlet. The respective hold-down member reaches into the enlarged inlet and outlet of the weft insertion channel.

The hold-down members assure that the weft thread ends are reliably and positively bound into the selvage and cannot unravel while wavy orientations or any loop formation by the weft thread ends are prevented.

Preferably the hold-down members are so arranged that they reach close to the beat-up line. The beat-up line also referred to as binding point is located in the back of the weft insertion channel when the reed is in its forward beat-up position. The forward tip of the hold-down members must not directly contact the binding point because in that case the hold-down members would damage the reed and/or to the hold-down members.

The hold-down members have substantially a curved shape or an L-configuration. The curved configuration is preferably a circular sector, whereby the sector may even be semi-circular. The forward tip of each hold-down member extends substantially horizontally and reaches into the enlarged inlet or outlet respectively of the weft insertion channel when the reed is in its foremost beat-up position. The forward tip of the hold-down members merges into or is connected to a bent or angled section constructed for mounting the respective hold-down member in the frame of the loom.

In another embodiment the hold-down members are formed as slightly bent sheet metal elements so that the mounting for the hold-down members projects hardly at all above the plane of the fabric supporting table. For any of these hold-down members, the required hold-down force can be provided in different ways. For example, a separate spring can press the respective hold-down member into the proper position. Where the hold-down members are constructed with a sufficient own weight, the respective inertia may be sufficient to provide the hold-down force. In yet another embodiment the hold-down members themselves have a spring elastic characteristic, whereby the spring force is so directed that it holds down the respective end of the weft thread upon completion of its insertion into the weft thread channel. In yet another embodiment the hold-down members may be operated by a respective drive element which derives its driving force for example from a compressed air source or from a hydraulic drive source of the loom. In such an embodiment the hold-down force can be adjusted in accordance with the requirements of the particular fabric being woven.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
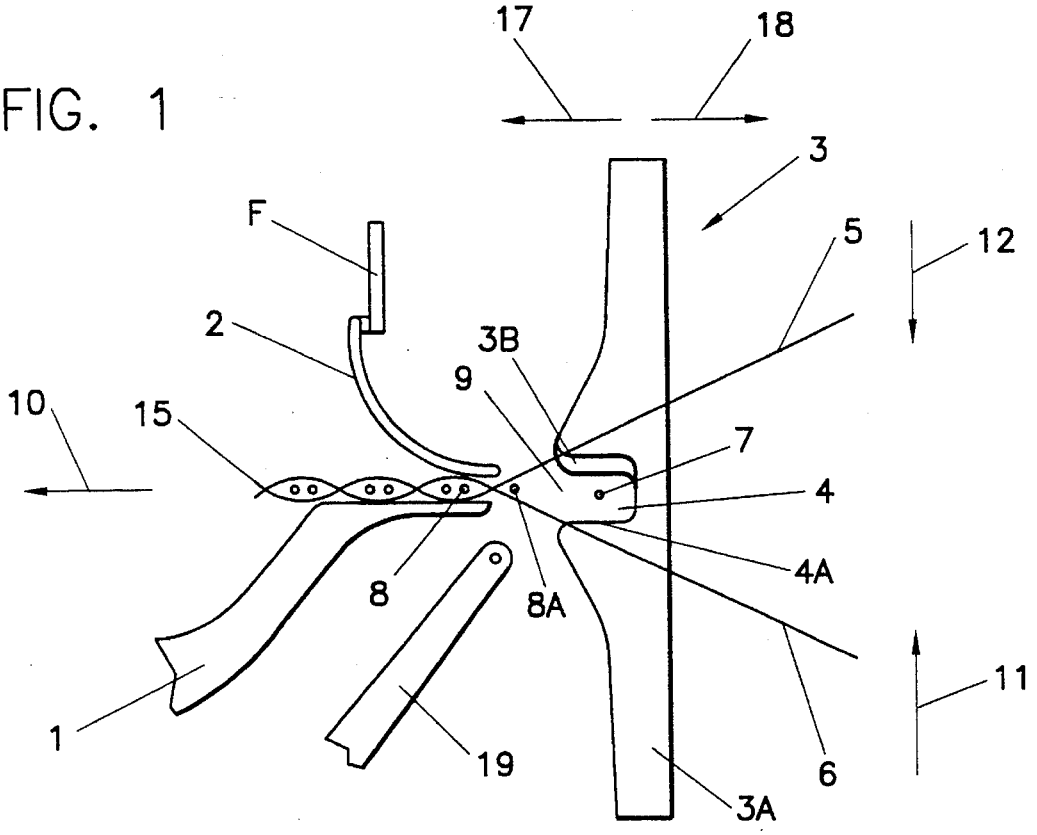
FIG. 1 shows a schematic side view of a reed in an air weaving loom of the invention prior to reaching a beat-up position.
Figure 2:
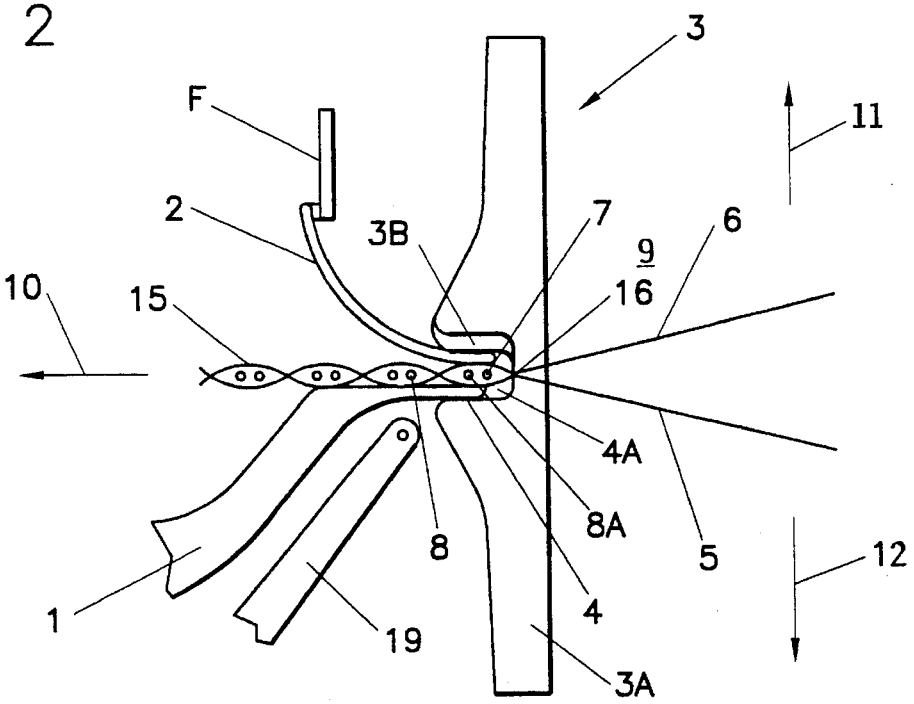
FIG. 2 is a view similar to that of FIG. 1, however showing the reed in the beat-up position.
Figure 3:
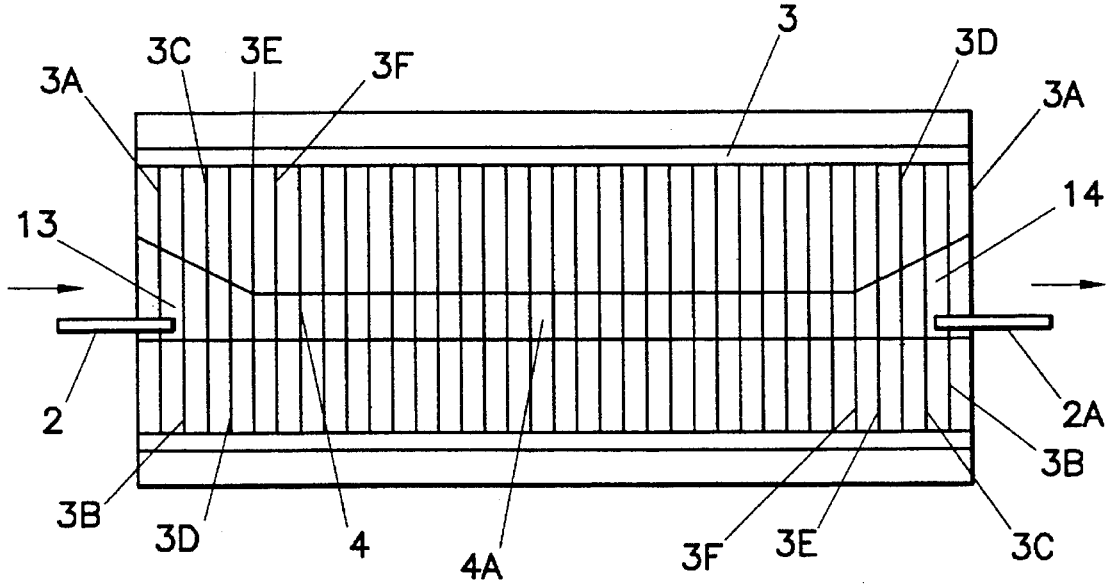
FIG. 3 is a schematic front view of the present reed illustrating on the left an enlarged inlet and on the right an enlarged outlet of the weft insertion channel with an intermediate channel section of normal size or normal cross-sectional area between the inlet and the outlet.

FIGS. 1 and 2 show a side view of a portion of an air weaving loom reed section illustrating the components essential for the present invention. The view is in the direction opposite to the weft insertion direction of a weft thread 7. A fabric 15 travels in the direction of the arrow 10 from right to left in FIG. 1. According to the invention hold-down members 2 and 2A are mounted in the machine frame F for cooperation with a fabric table 1 and with a reed 3 having reed teeth 3A, 3B and so forth. Both hold-down members 2 and 2A are shown in FIG. 3. The reed teeth have cut-outs 4A forming a weft insertion channel 4. FIGS. 1 and 2 show the exit end of the weft insertion channel whereby the weft thread 7 travels toward the viewer. The reed 3 performs beat-up movements in the direction of the arrow 17, whereby FIG. 2 illustrates the beat-up position, wherein the back of the weft insertion channel 4 contacts a beat-up line or "point" 16. When the reed 3 moves in the direction of the arrow 18 the shed formed by the warp threads 5 and 6 is opened, whereby the warp threads 5 and 6 change position as indicated by the arrows 11 and 12 to repeatedly form a shed 9. A beat-up weft thread 8 has a free end 8A that shall be bound into the selvage with the next beat-up motion of the reed 3.

FIGS. 1 and 2 also show relay nozzles 19 which are arranged alongside the weft insertion channel 4 for the complete transport of a weft thread 7 through the insertion channel 4. The main nozzle at the entrance to the channel 4 is not shown.

FIG. 3 shows the reed 3 provided according to the invention with the specially formed weft insertion channel 4 having an enlarged inlet 13 and an enlarged outlet 14. Reed teeth 3A to 3E are provided with differently sized cut-outs 4A to form the widened inlet and widened outlet 14. Reed teeth 3F are all provided with the same cut-out 4A to form an intermediate channel section having a normal or standard cross-sectional area between the inlet 13 and outlet 14. The hold-down member 2 is positioned at the inlet 13 of the weft insertion channel 4. The other hold-down member 2A is shown at the outlet 14 of the weft insertion channel 4 as shown symbolically in FIG. 3.

Referring further to FIG. 3, the cut-outs 4A of the reed teeth 3A, 3B, 3C, 3D, 3E at the inlet 13 have gradually diminishing cross-sectional areas so that the inlet 13 has a top surface slanting toward the standard cross-sectional area of the intermediate channel section in the intermediate reed section between the inlet 13 and the outlet 14. At the outlet 14 the slanting surface formed by the cut-outs in the reed teeth 3E, 3D, 3C, 3B, and 3A slants upwardly to gradually increase the cross-sectional area of the outlet 14 from the central intermediate section outwardly. With this arrangement of the inlet and outlet reed teeth there is sufficient space for the hold-down members 2 according to the invention to hold-down the weft thread in such a position that the respective thread ends 8A can be properly tucked into or looped back into the selvage by a respective 25 nozzle 20 shown in FIG. 4A, to be bound-in by the next beat-up as will be described in more detail below. FIG. 4A also shows the present hold-down member 2 at the weft insertion channel inlet 13 in a schematic top plan view.

Figure 3A:
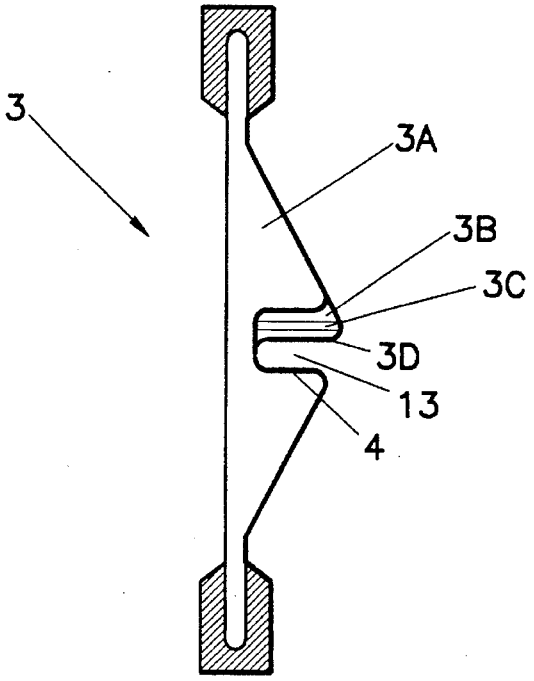
FIG. 3A illustrates a view in the direction of the arrow 13 into the enlarged or widened inlet of FIG. 3.

Referring first to FIG. 3A, the reed 3 is shown in a side view in the direction of the arrow at the inlet 13 in FIG. 3. The reed teeth 3B, 3C, and 3D behind the first reed tooth 3A are shown to form the inlet upper surface of the weft insertion channel. The reeds 3E and 3F are not shown in FIG. 3A to avoid crowding of lines. FIG. 3A shows that the cross-sectional surface areas of the cut-outs 4A become gradually smaller relative to each other to form the slanted top of the channel inlet 13.

Figure 4:
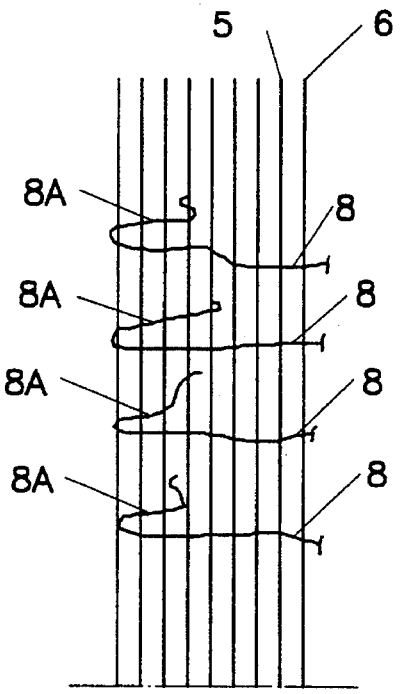
PRIOR ART FIG. 4
FIG. 4 illustrates a selvage formation in a conventional manner in which the looped backed weft thread ends do not assume a straight position substantially perpendicularly to the warp threads.
Figure 4A:
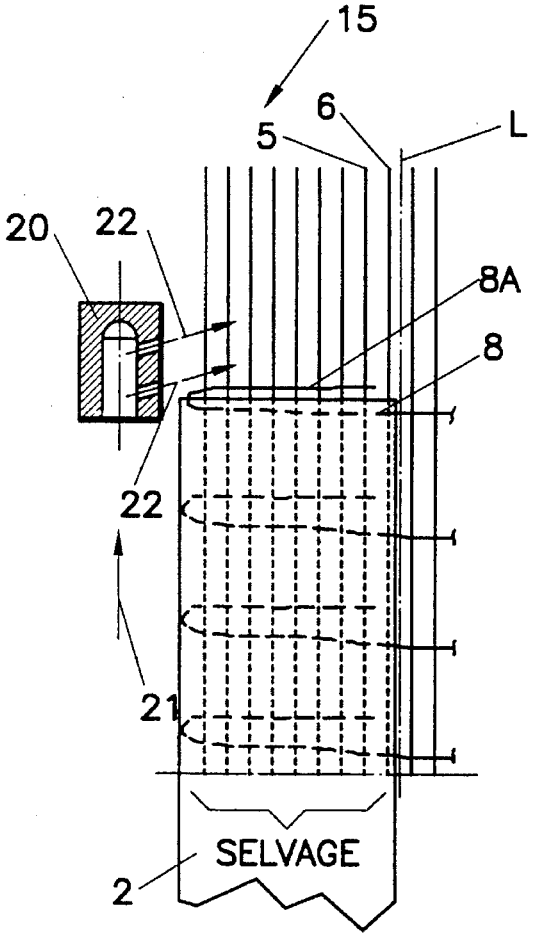
FIG. 4A shows a view similar to that of FIG. 4, but illustrating the position of a hold-down member and its effect on the straightening of the weft thread ends looped backed by a respective blow back nozzle.

FIG. 4 shows the selvage formation according to the prior art in which the ends 8A of the weft threads 8 are not uniformly and securely bound into the selvage because the ends 8A assume wavy forms and loops. Contrary thereto, FIG. 4A shows the returning of the weft ends 8A into the selvage along a substantially straight line due to the operation of the hold-down member 2 cooperating with the return nozzles 20 connected to a compressed air supply 21 to form airstreams 22 that loop the weft thread ends 8A back into the selvage formation to the left of the dash-dotted line L separating the selvage from the fabric proper.

Figure 5:
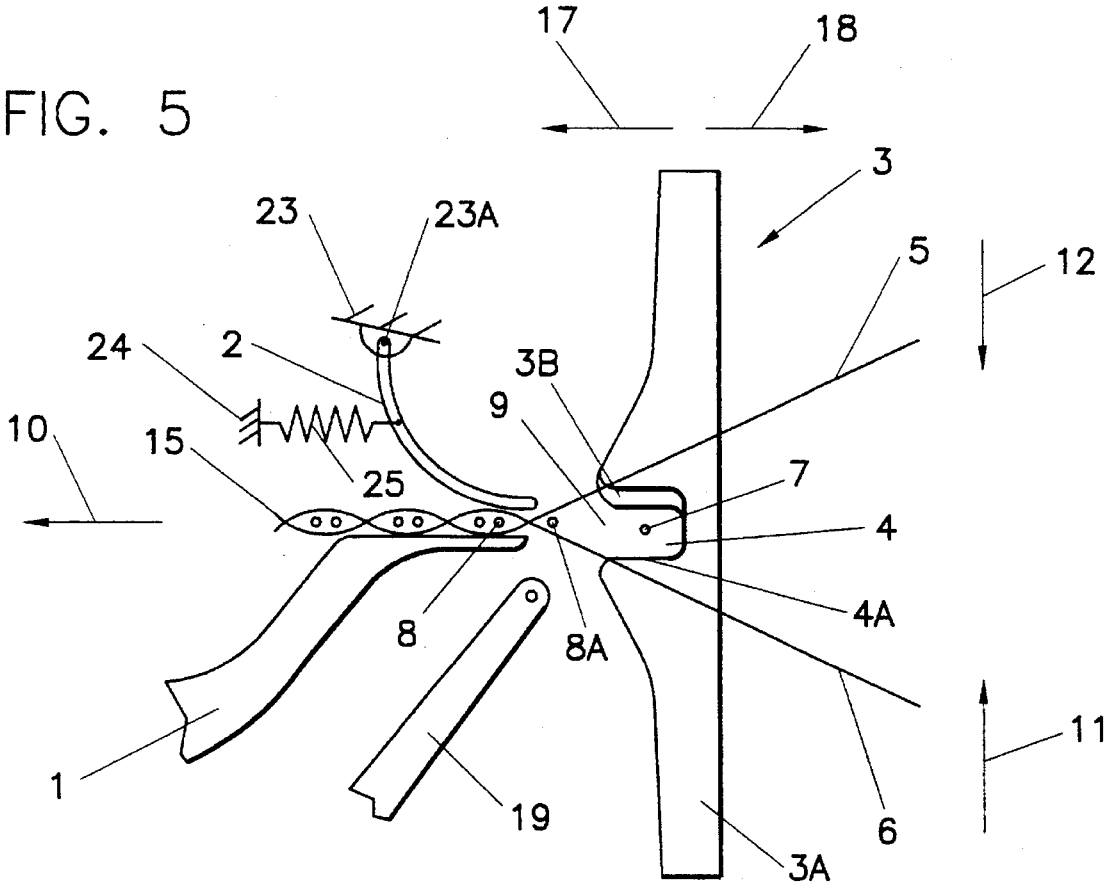
FIG. 5 shows the construction of a first embodiment of a hold-down member according to the invention operated by a spring.

FIG. 5 shows the hold-down member 2 in its working or hold-down position, whereby the forward end of the member holds down the weft ends. The rear end of the hold-down member 2 is journalled at 23A to the loom frame 23. A spring, preferably a tension spring 25 biases the member 2 into its shown working position. The spring 25 is secured with its opposite end to a mounting member 24 fixed to the machine frame. The spring force is so selected that the hold down force of the member 2 on the selvage prevents any unintended motion of the weft ends 8A.

Figure 6:
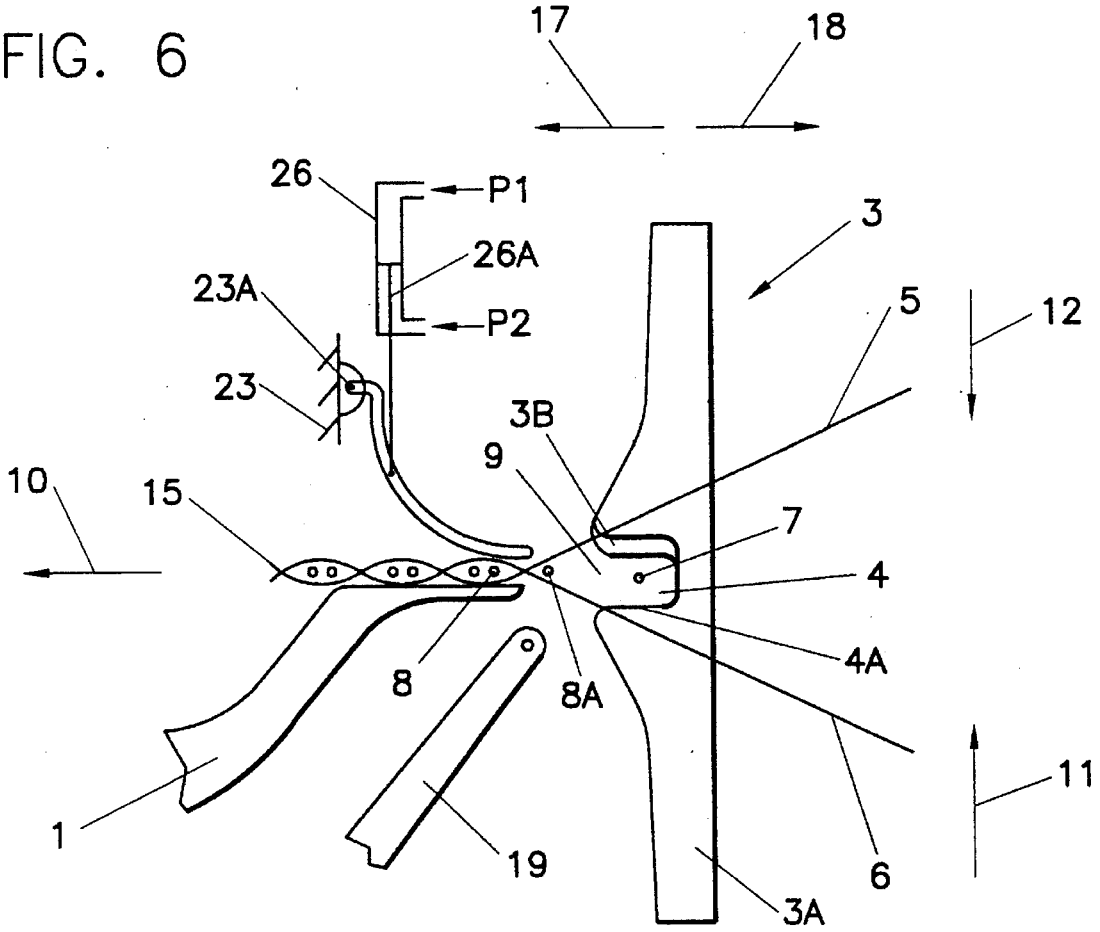
FIG. 6 illustrates another embodiment of a hold-down member of the invention operated by a piston cylinder device.

In FIG. 6 a piston cylinder unit 26 connected with its piston rod 26A to the hold-down member 2 keeps the latter in its working position. The hold-down member 2 is journalled at 23A to the loom frame 23. A pressure P1 supplies the necessary hold down force, while an opposing pressure P2 sufficiently lifts the member 2 during a respective fabric feed advance phase in the direction of the arrow 10. The pressure controls for operating the piston cylinder unit 26 are not shown since they are conventional.

Although the invention has been described with reference to specific example embodiments, it will be appreciated that it is intended to cover all modifications and equivalents within the scope of the appended claims.

What is claimed is:

1. An air weaving loom, comprising a reed having reed teeth with cut-outs forming together a weft thread insertion channel in said reed, said weft thread insertion channel having a weft inlet (13), an intermediate channel section (A) with a constant channel cross-sectional area, and a weft outlet (14), said weft inlet (13) and said weft outlet (14) each comprising an increased cross-sectional area relative to said constant channel cross-sectional area, said increased cross-sectional area of said weft inlet (13) diminishing toward said constant cross-sectional area, said increased cross-sectional area of said weft outlet (14) increasing away from said constant cross-sectional area so that said weft inlet (13) and said weft outlet (14) merge into said intermediate channel section, a first weft end hold-down member (2) mounted in said loom for holding a weft thread at said weft inlet, and a second weft end hold-down member (2A) mounted in said loom for holding said weft thread at said weft outlet, whereby weft thread ends are positively bound into a fabric selvage to prevent wavy orientations or loop formations of weft thread ends.

2. The air weaving loom of claim 1, wherein each of said increased cross-sectional areas provide a sufficient area for said first and second hold-down members respectively to reach close to a beat-up line (16) passing longitudinally through said weft thread insertion channel.

3. The air weaving loom of claim 1, wherein each of said first and second hold-down members (2, 2A) has a curved sectional configuration.

4. The air weaving loom of claim 1, wherein each of said first and second hold-down members (2, 2A) has an approximately L-sectional configuration.

5. The air weaving loom of claim 1, wherein said first and second hold-down members are heavy enough to be effective by their own weight for holding down a respective weft thread end.

6. The air weaving loom of claim 1, wherein said first and second hold-down members have an inherent spring characteristic.

7. The air weaving loom of claim 1, further comprising an operating member for each of said first and second hold-down members.

8. The air weaving loom of claim 7, wherein said operating member is a spring for each of said hold-down members.

9. The air weaving loom of claim 7, wherein said operating member is a piston cylinder unit for each of said hold down members.

10. The air weaving loom of claim 1, wherein said reed teeth forming said inlet and said reed teeth forming said outlet have cut-outs of increased cross-sections so that a reed tooth with the largest cut-out is positioned at an entrance to said inlet and at an exit of said outlet and reed teeth with progressively smaller cut-outs are positioned between said intermediate channel section and said weft inlet and said weft outlet exit respectively.

11. The air weaving loom of claim 1, wherein each of said reed teeth forming said intermediate channel section has said constant cross-sectional area along said intermediate channel section.

* * * * *

UNITED STATES PATENT AND TRADEMARK OFFICE

CERTIFICATE OF CORRECTION

PATENT NO. : 5,570,726

DATED : November 5, 1996

INVENTOR(S) : Wahhoud et al.

It is certified that error appears in the above-identified patent and that said Letters Patent is hereby corrected as shown below:

On the Title Page:

item [54] line 2, after "AND" insert --AN--;
line 3, after "OUTLET" insert --IN THE--.

item [56] References Cited:

U. S. PATENT DOCUMENTS:
insert: --4,919,171 04/90 Dornier.....
3,621,886 11/71 Van Mullekom.....--.

FOREIGN PATENT DOCUMENTS
insert: --0083905 7/83 European Pat. Off.
2348297 11/77 French Pat. Off.
2112442 4/90 Japan Pat. Off.--.

Col. 1, line 2, after "AND" insert --AN--;
line 3, after "OUTLET" insert --IN THE--.

Col. 2, line 26, replace "formation" by --formations--.

Col. 4, line 25, delete "25".

Signed and Sealed this

Eighteenth Day of February, 1997

*Attest:*

Bruce Lehman

BRUCE LEHMAN

*Attesting Officer*

*Commissioner of Patents and Trademarks*